US006098706A

United States Patent [19]

Urch

[11] Patent Number: 6,098,706

[45] Date of Patent: Aug. 8, 2000

[54] HEAT EXCHANGER

[75] Inventor: John Francis Urch, Cronulla, Australia

[73] Assignee: Eco Air Limited, Taren Point, Australia

[21] Appl. No.: 09/077,930

[22] PCT Filed: Nov. 15, 1996

[86] PCT No.: PCT/AU96/00731

§ 371 Date: Dec. 31, 1998

§ 102(e) Date: Dec. 31, 1998

[87] PCT Pub. No.: WO97/21062

PCT Pub. Date: Jun. 12, 1997

[30] Foreign Application Priority Data

Dec. 4, 1995 [AU] Australia ..... 6979/95

[51] Int. Cl.[7] ..... F28F 3/00

[52] U.S. Cl. ..... 165/166; 165/153; 165/165; 165/176; 165/DIG. 399

[58] Field of Search ..... 165/153, 166, 165/165, 176

[56] References Cited

U.S. PATENT DOCUMENTS

| | | | |
|---|---|---|---|
| 2,596,642 | 5/1952 | Boestad | 165/166 |
| 2,940,736 | 6/1960 | Odman | 165/166 |
| 3,258,832 | 7/1966 | Gerstung | 165/176 X |
| 3,508,607 | 4/1970 | Herrmann | 165/166 X |
| 3,734,178 | 5/1973 | Soudron . | |
| 4,219,080 | 8/1980 | Chaix et al. . | |
| 4,407,357 | 10/1983 | Hultgren | 165/165 |
| 5,443,116 | 8/1995 | Hayashi et al. | 165/153 X |
| 5,507,338 | 4/1996 | Schornhorst et al. | 165/153 X |
| 5,810,077 | 9/1998 | Nakamura et al. | 165/153 |

FOREIGN PATENT DOCUMENTS

| | | | |
|---|---|---|---|
| 0 040 890 | 12/1981 | European Pat. Off. . | |
| 28 26 343 | 1/1979 | Germany . | |
| 401884 | 11/1974 | Russian Federation . | |
| 1684581 | 10/1991 | Russian Federation | 165/176 |
| 688509 | 3/1953 | United Kingdom | 165/165 |
| 2 006 418 | 5/1979 | United Kingdom . | |
| 06709 | 9/1988 | WIPO . | |
| 01463 | 1/1993 | WIPO . | |
| 18360 | 9/1993 | WIPO . | |

*Primary Examiner*—Leonard Leo
*Attorney, Agent, or Firm*—Smith-Hill and Bedell

[57] ABSTRACT

A heat exchanger is formed from a metal strip wound concertina fashion to provide superimposed plates. The plates are stamped in pairs separated by a narrow section which forms a return bend for folding the two plates over one another. Each plate is provided with ribs shaped to guide gas flow paths through the pocket between an inlet in one corner region of the plate and an outlet in a second corner region of the plate. Corrugated zones are formed in the plate between the ribs to promote a whirling motion of air as it travels between the ribs flanking the corrugated zones.

10 Claims, 6 Drawing Sheets

HEAT EXCHANGER

FIELD OF INVENTION

THIS INVENTION relates to a heat exchanger and is more specifically concerned with one preferably made of metal although plastics material could be used, and which is designed for transferring heat between two gas streams which flow through primary and secondary passages of the heat exchanger in a largely or substantially counterflow manner.

STATE OF THE ART

In my Australian Patent No. 660,781 is described a counterflow heat exchanger of composite construction. It utilises a sinuously wound metal foil having moulded plastics baffle plates located in pockets provided between adjacent sections of the foil. Each baffle plate provides a set of largely parallel gas-flow paths extending between gas inlets and gas outlets. The inlets and outlets of each gas flow path are respectively arranged in separate lines at the sides of the pockets. This enables simple manifold connections to be made individually to each of the inlets and outlets. Such an arrangement of manifold connections is described in my Australian Patent No.637,090.

Although the above described heat exchanger can be made easily and reliably and has a high thermal efficiency, it relies on the use of plastics mouldings and these can only be made cheaply on a mass-production basis if relatively expensive production equipment is used. Also, as thermoplastics material are preferably used for the plates, the temperature of gases passed through the heat exchanger is naturally limited. Finally, the speed of production is restricted as a moulding technique is used.

OBJECT OF THE INVENTION

An objection of this invention is to provide a heat exchanger having basically counterflow characteristics and which is capable of being manufactured and assembled more quickly than is possible with a heat exchanger of composite construction.

THE INVENTION

In accordance with the present invention a heat exchanger has a stack of parallel pockets each formed between superimposed plates each providing a set of ribs having parallel straight sections connected by parallel curved sections, each pocket having the ribs of one flanking plate slightly offset with respect to the ribs of the other flanking plate so that the ribs of one plate provide spacers holding the flanking plates apart while dividing the pockets into substantially parallel U-shaped flow gas flow paths which extend between a gas inlet, provided along one corner region of the stack, and a gas outlet provided along a different corner region of the stack, the ribs of alternate plates being in registration with one another and being almost in registration with the ribs of the remaining plates which are also in registration with one another so that the corresponding parallel U-shaped gas flow paths in all of the pockets are in substantial registration with one another over the greater part of their lengths.

PREFERRED FEATURES OF THE INVENTION

The plates may be separate from one another. However it is preferred that they comprise rectangular stamped areas of a metal strip which is folded back and forth in concertina fashion to provide the pockets in the folds.

Conveniently, the plates are stamped in pairs with the ribs of one plate projecting from the opposite side of the plate, before it is folded, to the ribs on the other plate of the pair. This increases the rate of production of the stamped plates.

In one arrangement of heat exchanger made by the invention, the return bends of the ribs lie adjacent one face of the heat exchanger which is sealed by being immersed in a shallow tray of hot glue. The glue hardens quickly when the face of the heat exchanger is lifted from the tray, and forms a continuous wall which seals the face and traps the edges of the plates side-by-side in their required positions.

The two parallel sides of the stack adjacent the glued face may have flat windowed plates placed firmly against them so that the pockets in the stack are closed adjacent the face but are open at the opposite two corner regions of the stack remote from the glued face. This enables gas to pass via the windows to and from respective gas circuits of the heat exchanger.

Two parallel lines of openings enabling gas to pass from and to the respective gas circuits of the heat exchanger, are provided in the remaining face of the stack in the two corner regions, respectively. Suitably the portions of neighbouring plates which are not required to provide openings in said remaining face of the heat exchanger stack, are joined to one another by folded lock joints.

In one example of heat exchanger the plates have rectangular zones disposed between the ribs, corrugated to assist promotion of a whirling motion of the gases it flows through the channels formed between the ribs. The corrugations preferably extend at an acute angle to the direction of gas flow with the corrugations on one side of the pocket extending traversely of those on the other side to induce the gas whirling action.

INTRODUCTION TO THE DRAWINGS

The invention will now be described in more detail, by way of example, with reference to the accompanying largely diagrammatic drawings, in which:

In The Drawings

Figure 8:
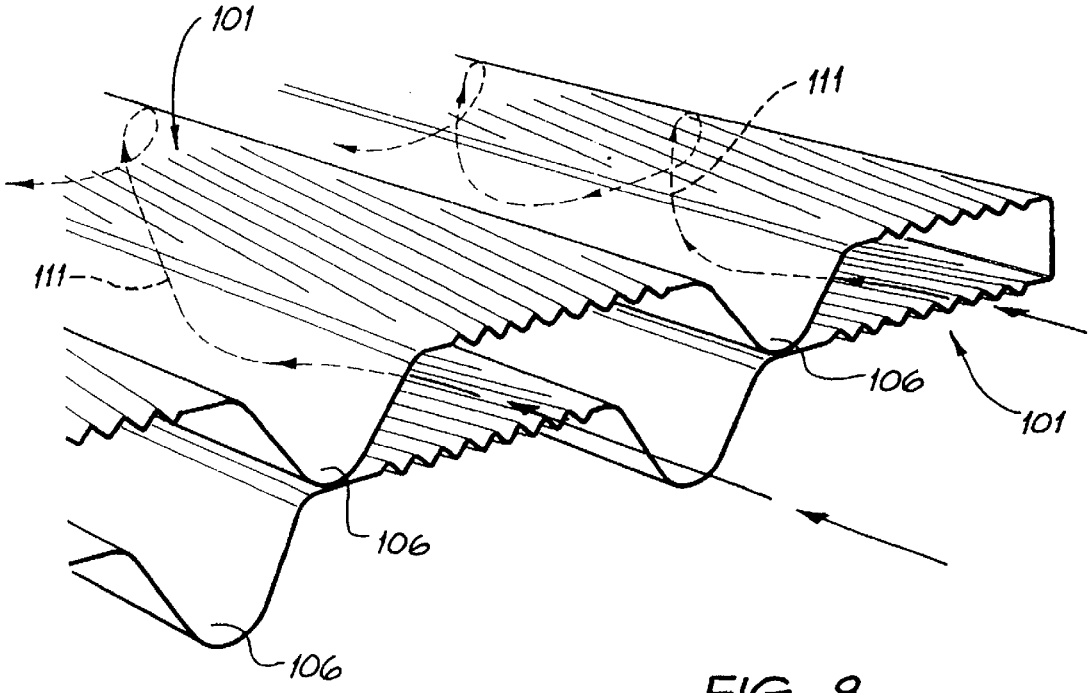
Figure 9A:
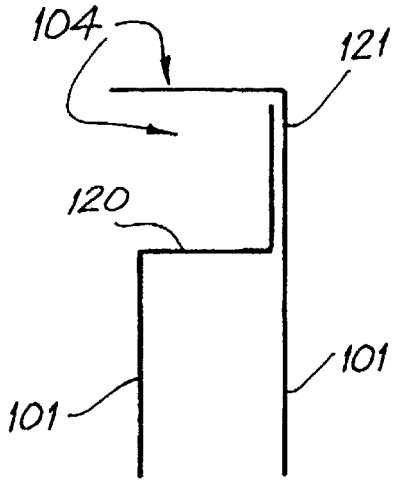
Figure 9B:
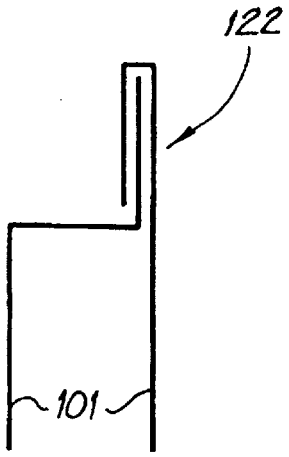
Figure 9C:
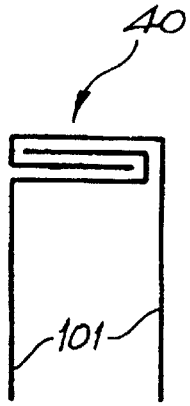
Figure 10:
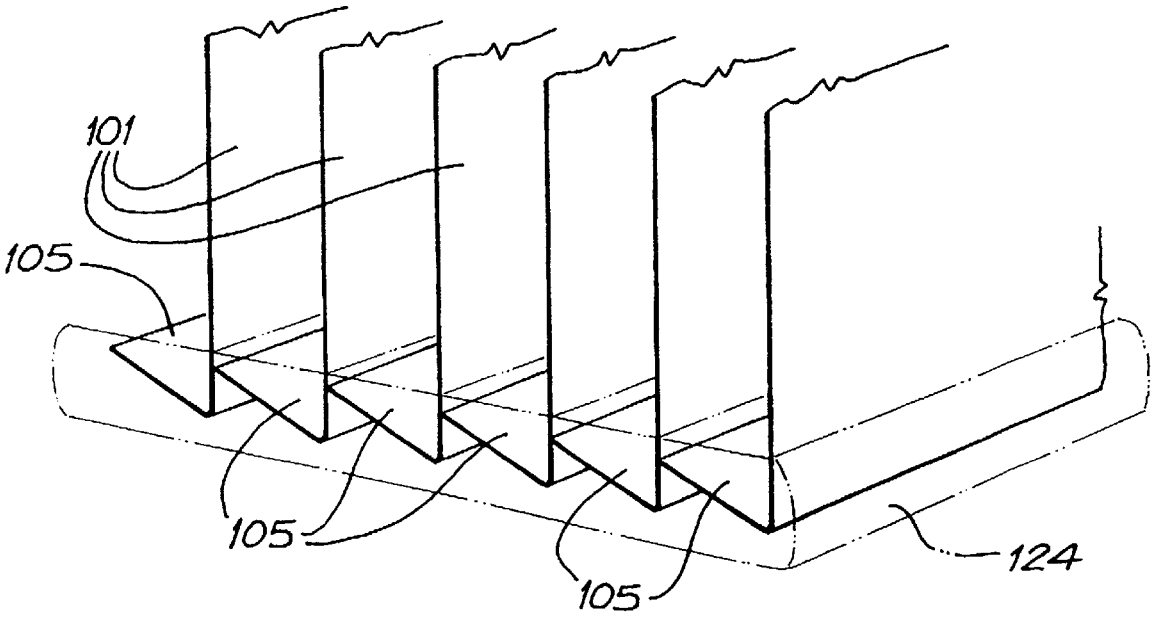

FIG. 8 diagrammatically shows how rectangular zones of corrugations formed on the plates between the ribs promotes whirling of the gas as it flows through a channel in the pocket;

FIG. 9 shows in diagrams 9A, 9B and 9C stages in the formation of a lock joint to used to close partially one side of one of the pockets in one face of the stack; and, FIG. 10 illustrates how the pockets are closed by a continuous glue seal on the opposite face of the stack to the face in which the locked joints are used.

DESCRIPTION OF FIRST EMBODIMENT

Figure 1:
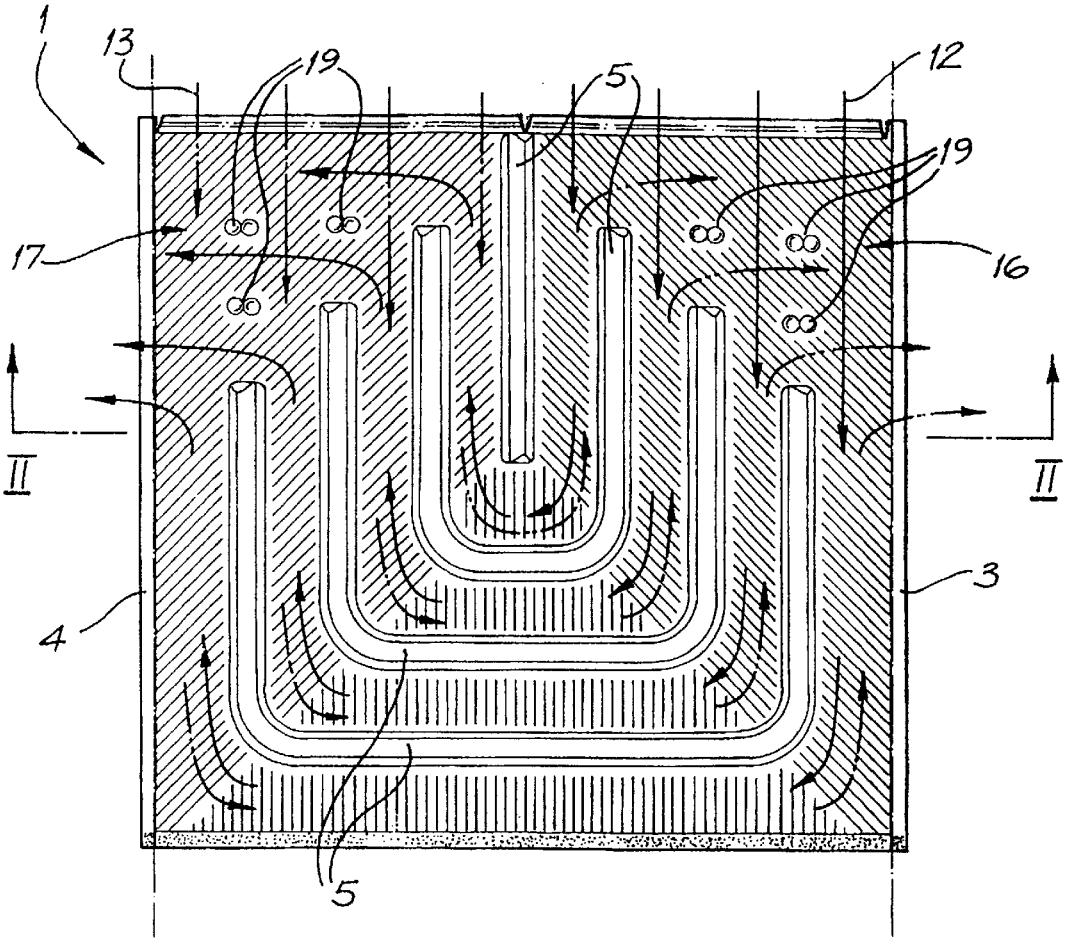
FIG. 1 is a plan view of a plate formed by a stamped section of an aluminium metal strip.
Figure 2:
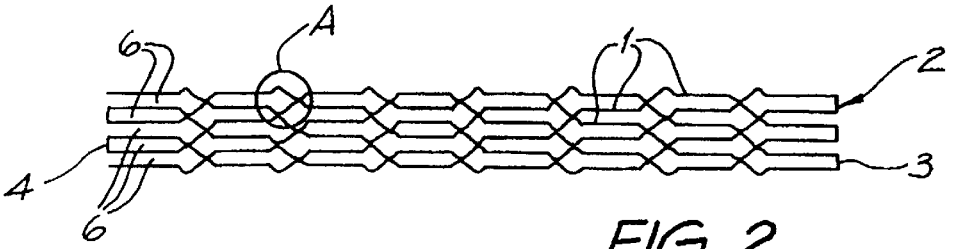
FIG. 2 shows schematically how a strip composed of several spaced sections or plates fabricated as shown in FIG. 1, is wound back and forth in sinuous form to provide a heat exchanger stack.

FIG. 1 shows a plate formed by a square area or section 1 of an aluminium strip 2 which is wound back and forth in concertina fashion as shown in FIG. 2 to form a heat exchanger stack only part of which is illustrated. The effect of winding the strip 2 back and forth is to bring neighbouring plates 1 of the strip into superimposed alignment with one another. The plates 1 are held in spaced parallel relationship so that a pocket 6 is formed between each pair of plates 1. A narrow band of the strip separates each pair of plates 1 and provides return bends 3 and 4 at respective opposite sides of the stack. The strip is 0.18 mm. thick, 400 mm. wide and of a sufficient length to make up to two hundred plates 1 each spaced by approximately 6 mm. from its neighbour.

Figure 3:
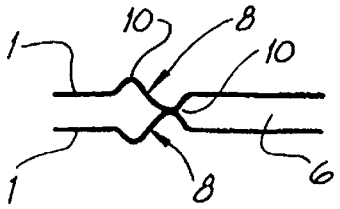
FIG. 3 is an enlarged detail of a ringed part of FIG. 2 identified by the letter A.

Returning to FIG. 1, each plate 1 is fabricated by a stamping technique which provides it with four elongated deformations 5 each of an assymetrical sine wave cross-section as shown at 8 in FIG. 3. This cross-section provides two ribs 10 projecting respectively from opposite faces of the section 1 and of different heights. The folding of the strip necessary to form the return bends 3 and 4 is so selected that the higher ribs 10 on one section 1 are brought into offset alignment with the lower ribs 10 of the neighbouring sections, as shown in FIG. 2, so that the ribs 10 on neighbouring plates abut one another to hold the plates 1 apart.

The deformations 5 act as guides to confine the flow of gas along substantially parallel channels as shown by the arrows 12 and 13 in FIG. 1. The arrows 12, shown in full outline, indicate the flow of gas through alternate pockets 6 of the stack, while the broken arrows 13 indicate the flow of gas through the remaining pockets 6 of the stack. As is apparent, the arrows 12 and 13 are substantially in counter-flow through most of their lengths which ensures the maximum heat transfer between a first gas at one temperature flowing through alternate pockets 6 of the stack, and a second gas at a different temperature flowing through the remaining pockets of the stack 6.

The areas of the strip forming the plates 1 and lying between the deformations 5 are corrugated by being formed with shallow parallel ripples 15 which stiffen the plates assist the creation of surface turbidity at the surface of the plates 1. This promotes good heat transfer between the pockets 6.

The deformations 5 of FIG. 1 guide the flow of gas through the pocket 6 between a triangular gas inlet zone 16 of the plate 1, and a triangular gas outlet zone 17. Each of these zones has pressed out of it three pairs of spacer domes 19. Each pair provides one dome extending out of one face of the plate 1 and a second dome 19 extending out of the opposite face of the section. The height of each dome 19 is equal to the height of each rib 10 formed on the same side of the same plate 1. Thus the ribs 10, the domes 19 and the return bends 3 and 4 ail act to maintain the desired spacing between the plate 1 as shown in FIGS. 2 and 3. It will be noticed that the pairs of domes 19 are aligned with the ends of two of the deformations 5.

Figure 4:
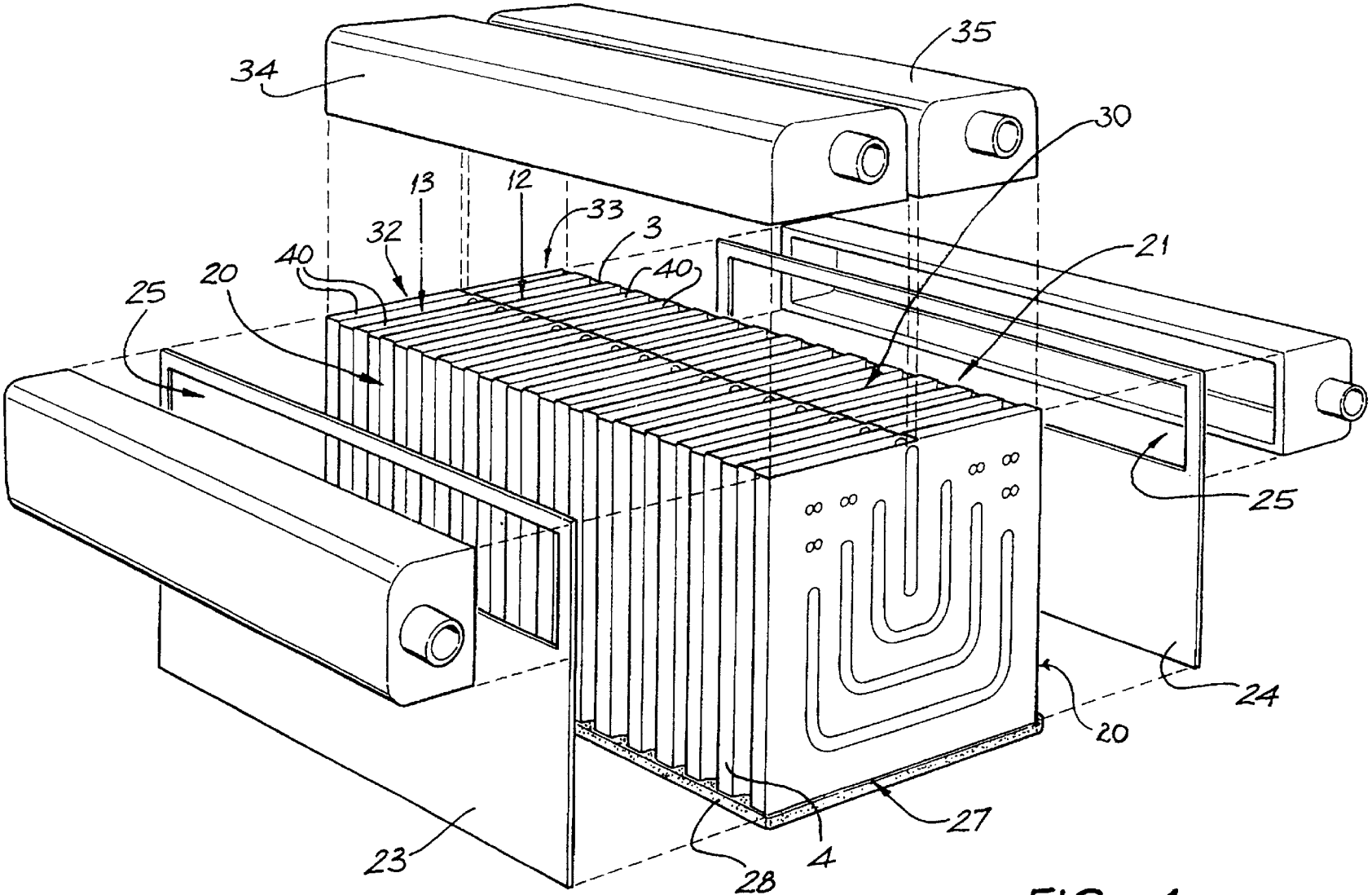
FIG. 4 is an exploded perspective view of part of a heat exchanger containing a stack of plates made from the corrugated strip of FIG. 2.
Figure 5:
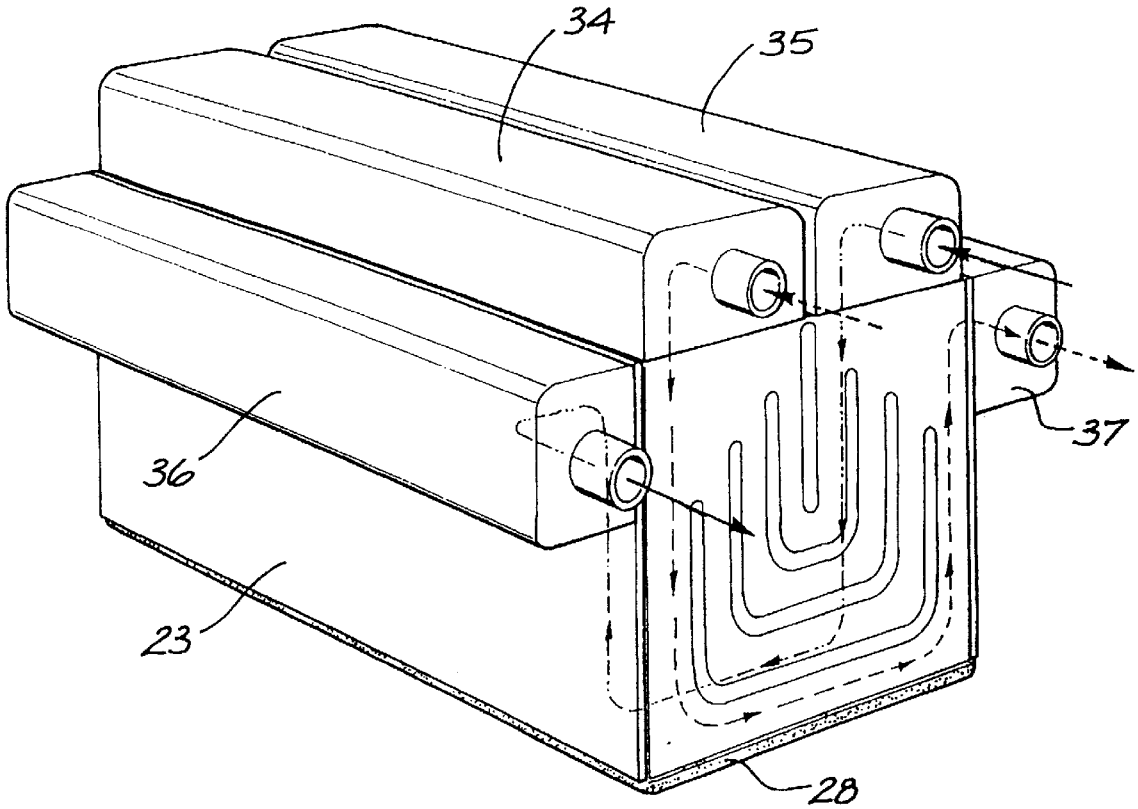
FIG. 5 is a perspective view of an assembled heat exchanger and shows by arrows the direction of gas flow through its primary and secondary circuits.

As shown in FIG. 4, the ret urn bends 4 and 3 respectively lie in two sides 20 and 21 of the heat exchanger stack. These sides are closed by flat windowed plates 23 and 24 which lie against the sides of the stack and are each formed with a rectangular window 25. The windows 25 define openings by which gas enters or leaves neighbouring pockets 6 of the stack and are positioned as shown in FIG. 5.

One of the remaining two sides of the stack, referenced 27 in FIG. 4, is entirely closed by a shallow glue seal 28.

The remaining side 30 is formed in one half 32 with the inlets of the broken arrow gas path 13, and in the other half 33 with the inlets of the full arrow gas path 12. Associated with the halves 32 and 33 are respective manifolds 34 and 35. Odd-numbered edges of the sections 1 lying in the stack side 30, have half their lengths sealed to the even-numbered edges of the sections 1 flanking them, by lock joints 40 constructed in stages as shown at 9A, 98 and 9C in FIG. 9. Thus, as shown in FIG. 4, the left-hand half 32 of the odd-numbered edges are sealed by lock joints at 40 to the left-hand half of the even-numbered edges numerically preceding them, and the right-hand half 33 of the odd-numbered edges are sealed by lock joints 40 to the right-hand half of the even-numbered edges numerically succeeding them. Alternate pockets 6 of the stack thereby open into the manifold 34 and the remaining pockets of the stack open into the manifold 35. The positions of these manifolds are clear from FIG. 5 which shows the assembled heat exchanger. The manifolds are not essential. The gas flow paths through the heat exchangers may open directly into ducting which is to carry the gas elsewhere.

The sealing of the edges of neighbouring sections to one another at 40 may be effected by other techniques than lock joints. For example, the sealing may be effected by track welding, by soldering or by cement or glue. The way chosen to effect the seals is immaterial.

The heat exchanger made as described above is capable of being produced quickly and cheaply by a mass-production technique. It has a high thermal efficiency by virtue of its counterflow characteristics, and, being made entirely of metal it can withstand relatively high gas temperatures. It also has the advantage that the ribs guide, rather than obstruct the gas flows through the pockets so that only low pressure drops are experienced between their inlets and outlets, even when relatively high gas flows are used of the order of 500 liters per second or less, up to flows of 1200 liters per second or more.

Although FIGS. 1 to 4 describe the construction of a heat exchanger having manifolds 34, 35 and further manifolds 36, 37 constructed as gas collection boxes, the use of such a manifold is not essential. In place of the manifolds the gas passages through its pockets may simply open into ducting.

If there is a risk of condensation forming in the heat exchanger during use, this may be removed by mounting the heat exchanger so that it is tilted downwardly towards one lower corner, and providing the pockets in which condensation could occur with bleed holes at the lower corners so that condensation empties from the pockets and flows to a drainage opening provided in the lowest corner of the heat exchanger.

DESCRIPTION OF SECOND EMBODIMENT

Figure 6:
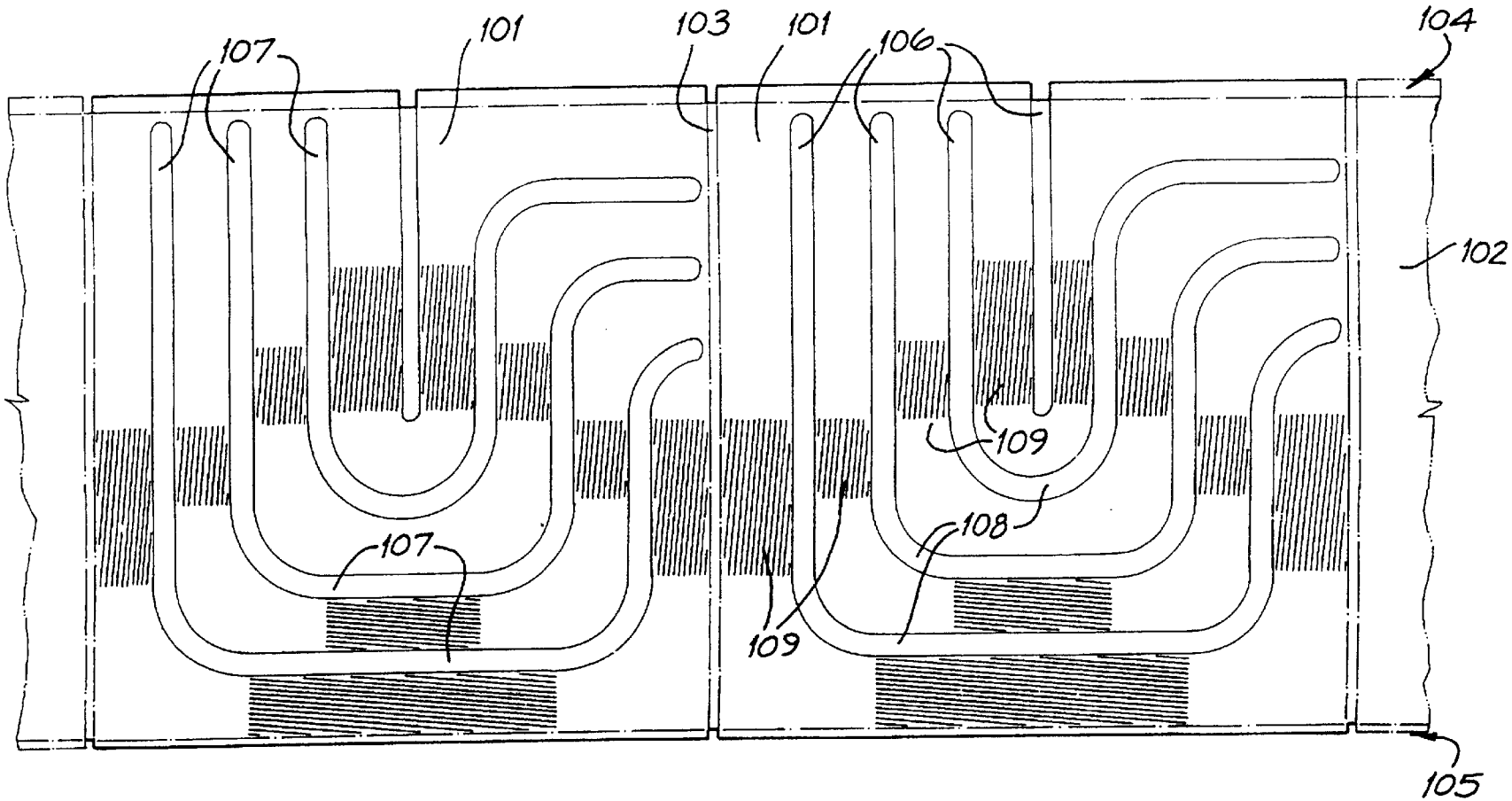
FIG. 6 shows a portion of a metal strip which, by a single stamping, is deformed to provide two plates of a different construction of heat exchanger.
Figure 7:
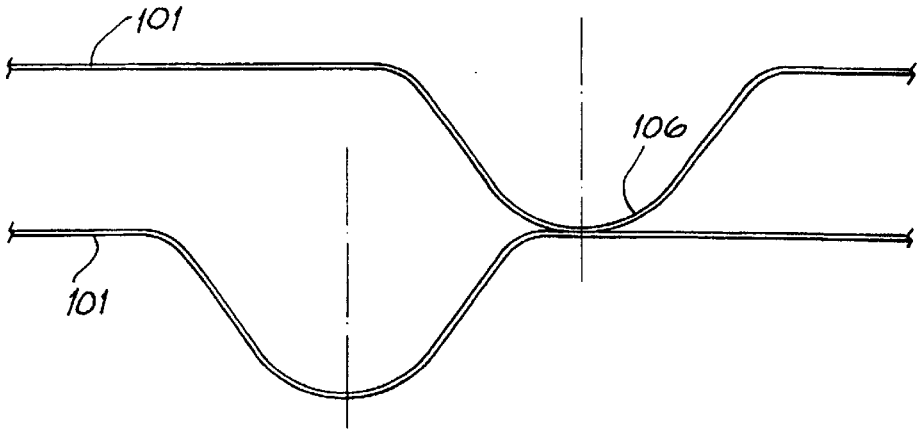
FIG. 7 is an enlarged view of a part of a pocket formed between two plates fabricated as described with reference to FIG. 6, and illustrates how the ribs act as spacers to hold apart the two plates flanking the pocket.

FIG. 6 shows two plates 101 which are simultaneously stamped out of metal foil strip 102. The two plates 101 are separated by narrow strip section 103 which is destined to provide a return bend when the strip 102 is wound back and forth in concertina fashion, to bring successive plates 101 into superimposed relationship as shown in FIGS. 7 and 8.

Each of the plates 101 is formed with opposed marginal edges 104, 105, respectively. A set of ribs 106 most of which are of U-shaped cross-section, as shown in FIG. 7, are stamped out of the plane of the plate 101 with the ribs of one plate 101 projecting from the opposite side of the plate to the ribs on the neighbouring plate. The ribs have linear sections 107 and curved sections 108.

Corrugated rectangular zones 109 lie between the linear sections of the ribs 106 and these have their corrugations extending at an acute angle of about 5° to the sections 107 of the ribs 106 bordering them.

The purpose of the corrugations will be understood from FIG. 8 which shows portions of two superimposed plates 107. The plates are formed from the same stamping, and the effect of folding them into superimposed relationship about the strip section 103, is to bring the ribs 106 into a slightly offset relationship so that each set of ribs 106 acts as spacer between two adjacent plates 101 as clearly shown in FIG. 7. The effect of folding the strips is also to orientate the corrugations of one plate 101 traversely with respect to the corrugations of the neighbouring plate 101 as shown in FIG. 8. As a gas flows down the channel between the ribs 106, the corrugated zones deflect the direction of flow of the gas. These deflections caused by the opposed corrugated zones 109, cause the gas to whirl as it flows down the channel so that it follows the path shown by the arrow 111. Such whirling acts to promote heat exchange between the gas and the plates between which it passes.

In other respects the heat exchanger made by using the strip stamped as described in FIG. 6, is the same as that described in the first embodiment. The description will therefore not be repeated to avoid needless repetition.

FIG. 9 shows the construction of the lock joint described earlier.

The marginal edges 104 of the two plates 101 produced by their simultaneous stamping, are deformed by the stamping respectively into the border profiles shown at 120 and 121, so that, after folding, they come together as shown in diagram 9A. A roller (not shown) is used to deform the terminal part of the border profile 121 over the terminal part of the other border profile 120, so that the profiles assume the shape 122 shown in sketch 9B. A further roller (not shown) is then used to bend the profiles of sketch 9B into the profile of sketch 9C, thus forming a lock joint 40 which holds the edges of the plates 101 together with the correct spacing while effectively sealing the pocket at the position of the lock joint 40.

FIG. 10 shows how plates 101 are sealed together at the under-face of the stack opposite the lock joints 40 of FIG. 9.

When the plates 101 of FIG. 6 are stamped out, their marginal edges 105 are bent sharply through 100° to bring their end edges into abutment with the neighbouring plate 101 when the two plates are folded into superimposed relationship. Gentle pressure is then applied between the opposite ends of the completed stack of plates to maintain the abutments. The stack is lowered into a shallow tray (not shown) of glue 124 which flows between the marginal edges 105 to fill all of the gaps surrounding them as shown in FIG. 10.

The glue 124 sets rapidly when the stack of plates is removed from the tray, and provides a seal as shown at 28 in FIG. 4, which holds the plates apart at the correct spacing while ensuring the pockets are sealed at their glued side.

Variations to the Embodiment

Conveniently the heat exchanger of FIG. 5 has attached to each of the manifolds 50, 51 a fan (not shown). The fans are driven at the same speed by a single motor also provided with the heat exchanger, and they have the same characteristics so that the gas pressure and flow through each pocket is substantially the same as occurs through the two pockets flanking it.

As already mentioned, the individual plates of the heat exchanger may be moulded from a plastics material, by vacuum forming or other suitable process for deforming the basic flat plate. The plastics material is one having good thermal conductivity and adequate rigidity.

I claim:

1. A heat exchanger having a stack of parallel pockets each formed between superimposed plates each providing a set of ribs having parallel straight sections connected by parallel curved sections, each pocket having the ribs of one flanking plate slightly offset with respect to the ribs of the other flanking plate so that the ribs of one plate provide spacers holding the flanking plates apart while dividing the pockets into substantially parallel U-shaped flow gas flow paths which extend between a gas inlet, provided along one corner region of the stack, and a gas outlet provided along a different corner region of the stack, the ribs of alternate plates being in registration with one another and being almost in registration with the ribs of the remaining plates which are also in registration with one another so that the corresponding parallel U-shaped gas flow paths in all of the pockets are in substantial registration with one another over the greater part of their lengths.

2. A heat exchanger as claimed in claim 1, in which the plates are metal.

3. A heat exchanger as claimed in claim 2, in which the plates form consecutive areas of a stamped metal strip.

4. A heat exchanger as claimed in claim 3, in which the plates are stamped from the strip in pairs with a narrow section of the strip extending between the plates of each pair to form a return bend therebetween, and the ribs which are stamped out of one plate of the pair extend in one direction out of the plane of the strip whereas the ribs which are stamped out of the other plate of the pair extend in the opposite direction out of the plane of the strip.

5. A heat exchanger as claimed in claim 1, in which the plates are made from a plastics material having good thermal conductivity and sufficient rigidity to maintain their shape during operation of the heat exchanger.

6. A heat exchanger as claimed in claim 1, in which lock joints are used to seal together adjacent portions of neighboring plates of the stack.

7. A heat exchanger as claim in claim 6, in which the edges of the plate remote from the lock joints are sealed together by having their marginal edge portions turned through slightly more than a right angle so that the edge of one plate abuts the neighboring plate, and the abutting portions of the plates are embedded in a sheet of hardened glue which seals one face of the stack and holds the adjacent portions of the plate in the required positions with respect to one another.

8. A heat exchanger as claimed in claim 1, in which portions of the plates between the ribs are corrugated and have their corrugations extending at an acute angle to the adjacent portions of the ribs to induce a whirling motion in the air passing through the pocket between the ribs flanking the corrugations.

9. A heat exchanger as claimed in claim 1, in which the ribs are of U-shaped cross-section and project from one side only of the plate from which they are formed.

10. A heat exchanger as claimed in claim 1, in which condensation drainage holes are provided in the lower corner regions of pockets in which there is a risk of condensation being formed during operation of the heat exchanger.

* * * * *